US009077115B2

(12) United States Patent
Yang

(10) Patent No.: US 9,077,115 B2
(45) Date of Patent: Jul. 7, 2015

(54) TERMINAL SET OF ELECTRICAL CONNECTOR

(71) Applicant: ALL BEST PRECISION TECHNOLOGY CO., LTD., Taoyuan County (TW)

(72) Inventor: Haven Yang, New Taipei (TW)

(73) Assignee: ALL BEST PRECISION TECHNOLOGY CO., LTD., Taoyuan (TW)

( * ) Notice: Subject to any disclaimer, the term of this patent is extended or adjusted under 35 U.S.C. 154(b) by 183 days.

(21) Appl. No.: 13/939,926

(22) Filed: Jul. 11, 2013

(65) Prior Publication Data

US 2015/0017822 A1 Jan. 15, 2015

(51) Int. Cl.

| | |
|---|---|
| ***H01R 13/648*** | (2006.01) |
| ***H01R 4/66*** | (2006.01) |
| ***H01R 13/6474*** | (2011.01) |
| *H01R 24/60* | (2011.01) |

(52) U.S. Cl.
CPC ..... *H01R 13/6474* (2013.01); *H01R 24/60* (2013.01)

(58) Field of Classification Search
CPC ..... H01R 4/66; H01R 24/22; H01R 13/11; H01R 13/6471; H01R 13/6474; H01R 24/60
USPC ..... 439/95
See application file for complete search history.

(56) References Cited

U.S. PATENT DOCUMENTS 5,387,112 A * 2/1995 Chishima ..... 439/67

* cited by examiner

*Primary Examiner* — Javaid Nasri
(74) *Attorney, Agent, or Firm* — WPAT, P.C.; Anthony King

(57) ABSTRACT

A terminal set of an electrical connector includes signal terminal duos and ground terminal duos. The signal terminal duos have two signal terminals. The signal terminals are spaced apart by a first distance and each have a first recess. The direction of the depth of the first recess equals the longitudinal direction of the signal terminals. The ground terminal duos have two ground terminals. The signal terminal duos are disposed between the ground terminals. The ground terminals each have a second recess. The direction of the depth of the second recess equals the longitudinal direction of the ground terminals. The ground terminal and the adjacent signal terminal are spaced apart by a second distance. The first distance is shorter than the second distance. The ground terminals each partially bulges out transversely to form at least a bulging portion. The terminal set features terminal electrical impedance and alleviated inter-terminal resonance.

13 Claims, 9 Drawing Sheets

TERMINAL SET OF ELECTRICAL CONNECTOR

FIELD OF THE INVENTION

The present invention relates to terminal sets of an electrical connector, and more particularly, to a terminal set of an electrical connector to adjust terminal electrical impedance and alleviate inter-terminal resonance.

BACKGROUND OF THE INVENTION

Due to technological advancement, manufacturers nowadays have tasks, such as observation, control, measurement and recording, performed by means of advanced apparatuses during a manufacturing process. The apparatuses are each equipped with at least an electrical connector for connecting the apparatuses and transmitting data therebetween. Although a conventional terminal of an electrical connector is capable of electrical connection and electronic signal transmission, it is not capable of adjusting terminal electrical impedance to meet different manufacturing-related needs. Furthermore, inter-terminal resonance occurs to the conventional electrical connector.

Accordingly, it is imperative to provide a terminal set of an electrical connector to adjust terminal electrical impedance and alleviate inter-terminal resonance.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a terminal set of an electrical connector as disclosed in the present invention to adjust terminal electrical impedance and alleviate inter-terminal resonance.

In order to achieve the above and other objectives, the present invention provides a terminal set of an electrical connector, comprising: signal terminal duos having two signal terminals, the signal terminals being spaced apart transversely and each having a first recess, wherein direction of a depth of the first recess equals longitudinal direction of the signal terminals; and ground terminal duos having two ground terminals flanking the signal terminal duos, the ground terminals each having a second recess and being spaced apart transversely from the signal terminals, wherein direction of a depth of the second recess equals longitudinal direction of the ground terminals.

As regards the terminal set of an electrical connector, the signal terminals each being V-shaped and comprising a first electrical connection portion and a first fixing portion, the first recess being disposed at one of the first fixing portion and the first electrical connection portion, and the ground terminals each being V-shaped and comprising a second electrical connection portion and a second fixing portion, the second recess being disposed at the second fixing portion or the second electrical connection portion.

As regards the terminal set of an electrical connector, the first recess either faces away from or faces the first electrical connection portion when the first recess is disposed at the first fixing portion and either faces away from or faces the first fixing portion when the first recess is disposed at the first electrical connection portion, and the second recess either faces away from or faces the second electrical connection portion when the second recess is disposed at the second fixing portion and either faces away from or faces the second fixing portion when the second recess is disposed at the second electrical connection portion.

As regards the terminal set of an electrical connector, an end of the first electrical connection portion and an end of the second electrical connection portion have their respective curved electrical connection structures.

As regards the terminal set of an electrical connector, an end of the first fixing portion and an end of the second fixing portion either faces away from or faces the first electrical connection portion and the second electrical connection portion and extend to form fixing structures, respectively.

In the second embodiment of the present invention, a terminal set of an electrical connector comprises: signal terminal duos having two signal terminals, the signal terminals being spaced apart transversely by a first distance and each having a first recess, wherein direction of a depth of the first recess equals longitudinal direction of the signal terminals; and ground terminal duos having two ground terminals flanking the signal terminal duos, the ground terminals each having a second recess, being spaced apart transversely from a corresponding one of the signal terminals by a second distance, and having at least a bulging portion bulging out transversely, wherein direction of a depth of the second recess equals longitudinal direction of the ground terminals, the first distance being shorter than the second distance.

As regards the terminal set of an electrical connector, the signal terminals each being V-shaped and comprising a first electrical connection portion and a first fixing portion, the first recess being disposed at one of the first fixing portion and the first electrical connection portion, and the ground terminals each being V-shaped and comprising a second electrical connection portion and a second fixing portion, the second recess being disposed at one of the second fixing portion and the second electrical connection portion.

As regards the terminal set of an electrical connector, the first recess either faces away from or faces the first electrical connection portion when the first recess is disposed at the first fixing portion and either faces away from or faces the first fixing portion when the first recess is disposed at the first electrical connection portion, and the second recess either faces away from or faces the second electrical connection portion when the second recess is disposed at the second fixing portion and either faces away from or faces the second fixing portion when the second recess is disposed at the second electrical connection portion.

As regards the terminal set of an electrical connector, the bulging portion is disposed at the second fixing portion or the second electrical connection portion.

As regards the terminal set of an electrical connector, the bulging portion is spaced transversely apart from a corresponding one of the signal terminals by a third distance, and the first distance is not shorter than the third distance.

As regards the terminal set of an electrical connector, the ground terminals have a smaller transverse width than the signal terminals.

As regards the terminal set of an electrical connector, an end of the first electrical connection portion and an end of the second electrical connection portion have their respective curved electrical connection structures.

As regards the terminal set of an electrical connector, an end of the first fixing portion and an end of the second fixing portion either face away from or face the first electrical connection portion and the second electrical connection portion and extend to form fixing structures, respectively.

Accordingly, the present invention provides a terminal set of an electrical connector to adjust terminal electrical impedance and alleviate inter-terminal resonance.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
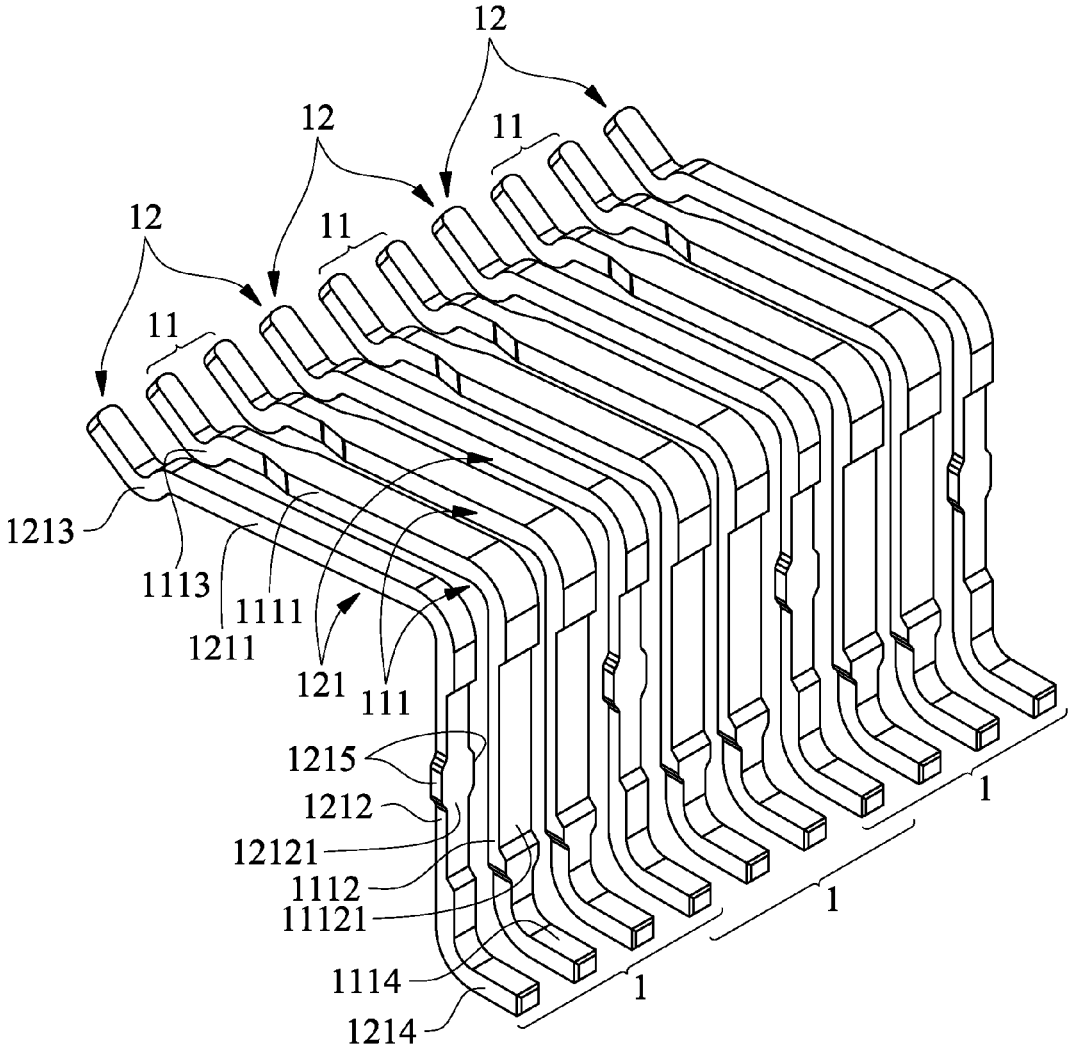
FIG. 1 is a schematic perspective view of a terminal set of an electrical connector according to the specific embodiment of the present invention.

The present invention relates to terminals of an electrical connector and the application of the terminals of an electrical connector, wherein, in practice, the terminals come in the form of upper and lower terminals; hence, the present invention is directed to the upper and lower terminals of an electrical connector. For the sake of brevity, the present invention is hereunder exemplified by and illustrated with the upper terminals of an electrical connector. Referring to FIG. 1 through FIG. 5, in the first embodiment of the present invention, the upper terminals of an electrical connector is further exemplified by and illustrated with a terminal set 1 of an electrical connector. The terminal set 1 of an electrical connector comprises signal terminal duos 11 and ground terminal duos 12. The signal terminal duos 11 have two signal terminals 111. The signal terminals 111 are parallel, spaced apart transversely, and each have a first recess 11121. The direction of the depth of the first recess 11121 equals the longitudinal direction of the signal terminals 111. The deeper the first recess 11121 is, the lesser the transverse cross-sectional area of the first recess-disposed portion of the signal terminals 111 is, and the larger the electrical impedance of the signal terminals 111 is. Conversely, the signal terminals 111 with shallow said first recess 11121 have relatively low electrical impedance. The ground terminal duos 12 have two ground terminals 121. The signal terminal duos 11 are disposed between the ground terminals 121. The ground terminals 121 each have a second recess 12121. The direction of the depth of the second recess 12121 equals the longitudinal direction of the ground terminals 121. The deeper the second recess 12121 is, the lesser the transverse cross-sectional area of the ground terminals 121 is, and the larger the electrical impedance of the ground terminals 121 is. Conversely, the ground terminals 121 with shallow said second recess 12121 have relatively low electrical impedance. The ground terminals 121 are parallel to the signal terminals 111 and are spaced apart therefrom transversely.

Accordingly, in the first embodiment of the present invention, due to the first recess 11121 and the second recess 12121, it is feasible to achieve different levels of electrical impedance of the signal terminals 111 and the ground terminals 121 of the terminal set 1 of an electrical connector as needed. Furthermore, referring to FIG. 1, the terminal set 1 of an electrical connector in the first embodiment of the present invention is provided in plurality as needed.

Referring to FIG. 1 through FIG. 5, the signal terminals 111 each are V-shaped and comprise a first electrical connection portion 1111 and a first fixing portion 1112 which form the two legs of the V-shaped configuration of each said signal terminal 111, respectively. The first recess 11121 is disposed at either the first fixing portion 1112 or the first electrical connection portion 1111. The lower end of the first fixing portion 1112 is either connected and fixed to, or soldered and fixed to, a circuit board or any other electrical structure (not shown) so as to transmit an electronic signal. The included angle between the first electrical connection portion 1111 and the first fixing portion 1112 is an acute angle, an obtuse angle, or a right angle. The front end of the first electrical connection portion 1111 is in electrical connection (or contact) with a terminal of an inserted component (not shown) so as to transmit an electronic signal. Furthermore, the signal terminals 111 manifest resilience; hence, as soon as the terminal of the inserted component comes into electrical connection (or contact) with the first electrical connection portion 1111, the terminal of the inserted component pushes the front end of the first electrical connection portion 1111 upward; meanwhile, the first electrical connection portion 1111 exerts a downward resilient restoring force on the terminal of the inserted component to make sure that the first electrical connection portion 1111 is in electrical connection (or contact) with the terminal of the inserted component. Furthermore, the ground terminals 121 each are V-shaped and comprise a second electrical connection portion 1211 and a second fixing portion 1212 which form the two legs of the V-shaped configuration of each said ground terminal 121, respectively. The second recess 12121 is disposed at either the second fixing portion 1212 or the second electrical connection portion 1211. The lower end of the second fixing portion 1212 is either connected and fixed to, or soldered and fixed to, a circuit board or any other electrical structure (not shown) so as to transmit an electronic signal. The included angle between the second electrical connection portion 1211 and the second fixing portion 1212 is an acute angle, an obtuse angle, or a right angle. The front end of the second electrical connection portion 1211 is in electrical connection (or contact) with a terminal of an inserted component (not shown) so as to transmit an electronic signal. Furthermore, the ground terminals 121 manifest resilience; hence, as soon as the terminal of the inserted component comes into electrical connection (or contact) with the second electrical connection portion 1211, the terminal of the inserted component pushes the front end of the second electrical connection portion 1211 upward; meanwhile, the second electrical connection portion 1211 exerts a downward resilient restoring force on the terminal of the inserted component to make sure that the second electrical connection portion 1211 is in electrical connection (or contact) with the terminal of the inserted component.

Referring to FIG. 1 through FIG. 5, if the first recess 11121 is disposed at the first fixing portion 1112, the first recess

11121 either faces away from or faces the first electrical connection portion 1111; likewise, if the first recess 11121 is disposed at the first electrical connection portion 1111, the first recess 11121 either faces away from or faces the first fixing portion 1112. Furthermore, if the second recess 12121 is disposed at the second fixing portion 1212, the second recess 12121 either faces away from or faces the second electrical connection portion 1211; likewise, if the second recess 12121 is disposed at the second electrical connection portion 1211, the second recess 12121 either faces away from or faces the second fixing portion 1212.

Figure 2:
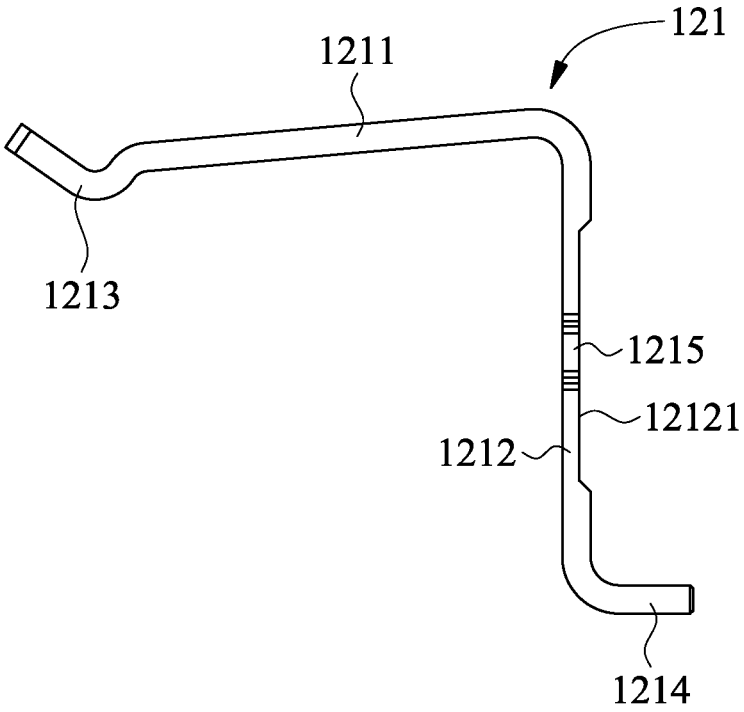
FIG. 2 is a front view of the terminal set of an electrical connector.

Referring to FIG. 1 and FIG. 2, the front end of the first electrical connection portion 1111 and the front end of the second electrical connection portion 1211 have their respective curved electrical connection structures 1113, 1213. As soon as a terminal of an inserted component (not shown) moves horizontally toward the first fixing portion 1112 and the second fixing portion 1212 and pushes the front end of the first electrical connection portion 1111 and the front end of the second electrical connection portion 1211 upward, the terminal of the inserted component pushes the front end of the first electrical connection portion 1111 and the front end of the second electrical connection portion 1211 upward smoothly because of the smooth lower edges of the curved electrical connection structures 1113, 1213 in a less laborious manner and in a way conducive to reduction of wear.

Referring to FIG. 1 and FIG. 2, the lower end of the first fixing portion 1112 and the lower end of the second fixing portion 1212 either face away from or face the first electrical connection portion 1111 and the second electrical connection portion 1212 and extend horizontally to form fixing structures 1114, 1214, respectively. Due to the fixing structures 1114, 1214, the lower end of the first fixing portion 1112 and the lower end of the second fixing portion 1212 have a relatively large surface area whereby the lower end of the first fixing portion 1112 and the lower end of the second fixing portion 1212 are either connected and fixed to, or soldered and fixed to, a circuit board or any other electrical structure (not shown) firmly.

Referring to FIG. 1 through FIG. 5, in the second embodiment of the present invention, the terminal set 1 of an electrical connector comprises signal terminal duos 11 and ground terminal duos 12. The signal terminal duos 11 have two signal terminals 111. The signal terminals 111 are parallel, spaced apart transversely by a first distance 13 (which is the shortest distance between two adjacent signal terminals 111), and each have a first recess 11121. The direction of the depth of the first recess 11121 equals the longitudinal direction of the signal terminals 111. The deeper the first recess 11121 is, the lesser the transverse cross-sectional area of the first recess-disposed portion of the signal terminals 111 is, and the larger the electrical impedance of the signal terminals 111 is. Conversely, the signal terminals 111 with shallow said first recess 11121 have relatively low electrical impedance. The ground terminal duos 12 have two ground terminals 121. The signal terminal duos 11 are disposed between the ground terminals 121. The ground terminals 121 each have a second recess 12121. The direction of the depth of the second recess 12121 equals the longitudinal direction of the ground terminals 121. The deeper the second recess 12121 is, the lesser the transverse cross-sectional area of the ground terminals 121 is, and the larger the electrical impedance of the ground terminals 121 is. Conversely, the ground terminals 121 with shallow said second recess 12121 have relatively low electrical impedance. Furthermore, the ground terminals 121 are parallel to the signal terminals 111 and are spaced apart therefrom transversely by a second distance 14 (which is the shortest distance between the signal terminal 111 and the bulging portion-free part of the ground terminal 121.) The first distance 13 is shorter than the second distance 14. Furthermore, the ground terminals 121 each have at least a bulging portion 1215 which bulges out therefrom transversely. The bulging portion 1215 is disposed either leftward or rightward at the ground terminal 121. Alternatively, the bulging portions 1215 flank the ground terminal 121.

Accordingly, in the second embodiment of the present invention, the signal terminals 111 and the ground terminals 121 of the terminal set 1 of an electrical connector are characterized in that, due to the first recess 11121 and the second recess 12121, the electrical impedances of the signal terminals 111 and the ground terminals 121 varies with the transverse cross-sectional area of the recess-disposed portions of the signal terminals 111 and the ground terminals 121 as needed. Furthermore, in the second embodiment of the present invention, the signal terminals 111 and the ground terminals 121 of the terminal set 1 of an electrical connector are characterized in that inter-terminal resonance alleviates because of the bulging portion 1215 and the fact that the first distance 13 is shorter than the second distance 14. Furthermore, as shown in FIG. 1, the terminal set 1 of an electrical connector in the second embodiment of the present invention is provided in plurality as needed.

Referring to FIG. 1 through FIG. 5, the signal terminals 111 each are V-shaped and comprise a first electrical connection portion 1111 and a first fixing portion 1112 which form the two legs of the V-shaped configuration of each said signal terminal 111, respectively. The first recess 11121 is disposed at either the first fixing portion 1112 or the first electrical connection portion 1111. The lower end of the first fixing portion 1112 is either connected and fixed to, or soldered and fixed to, a circuit board or any other electrical structure (not shown) so as to transmit an electronic signal. The included angle between the first electrical connection portion 1111 and the first fixing portion 1112 is an acute angle, an obtuse angle, or a right angle. The front end of the first electrical connection portion 1111 is in electrical connection (or contact) with a terminal of an inserted component (not shown) so as to transmit an electronic signal. Furthermore, the signal terminals 111 manifest resilience; hence, as soon as the terminal of the inserted component comes into electrical connection (or contact) with the first electrical connection portion 1111, the terminal of the inserted component pushes the front end of the first electrical connection portion 1111 upward; meanwhile, the first electrical connection portion 1111 exerts a downward resilient restoring force on the terminal of the inserted component to make sure that the first electrical connection portion 1111 is in electrical connection (or contact) with the terminal of the inserted component. Furthermore, the ground terminals 121 each are V-shaped and comprise a second electrical connection portion 1211 and a second fixing portion 1212 which form the two legs of the V-shaped configuration of each said ground terminal 121, respectively. The second recess 12121 is disposed at either the second fixing portion 1212 or the second electrical connection portion 1211. The lower end of the second fixing portion 1212 is either connected and fixed to, or soldered and fixed to, a circuit board or any other electrical structure (not shown) so as to transmit an electronic signal. The included angle between the second electrical connection portion 1211 and the second fixing portion 1212 is an acute angle, an obtuse angle, or a right angle. The front end of the second electrical connection portion 1211 is in electrical connection (or contact) with a terminal of an inserted component (not shown) so as to transmit an electronic signal. Furthermore, the ground terminals 121 manifest resilience;

hence, as soon as the terminal of the inserted component comes into electrical connection (or contact) with the second electrical connection portion 1211, the terminal of the inserted component pushes the front end of the second electrical connection portion 1211 upward; meanwhile, the second electrical connection portion 1211 exerts a downward resilient restoring force on the terminal of the inserted component to make sure that the second electrical connection portion 1211 is in electrical connection (or contact) with the terminal of the inserted component.

Referring to FIG. 1 through FIG. 5, if the first recess 11121 is disposed at the first fixing portion 1112, the first recess 11121 either faces away from or faces the first electrical connection portion 1111; likewise, if the first recess 11121 is disposed at the first electrical connection portion 1111, the first recess 11121 either faces away from or faces the first fixing portion 1112. Furthermore, if the second recess 12121 is disposed at the second fixing portion 1212, the second recess 12121 either faces away from or faces the second electrical connection portion 1211; likewise, if the second recess 12121 is disposed at the second electrical connection portion 1211, the second recess 12121 either faces away from or faces the second fixing portion 1212.

Referring to FIG. 1 through FIG. 5, the bulging portion 1215 is disposed at either the second fixing portion 1212 or the second electrical connection portion 1211 to meet various design-related needs, assembly-related needs, and manufacturing-related needs.

Figure 3:
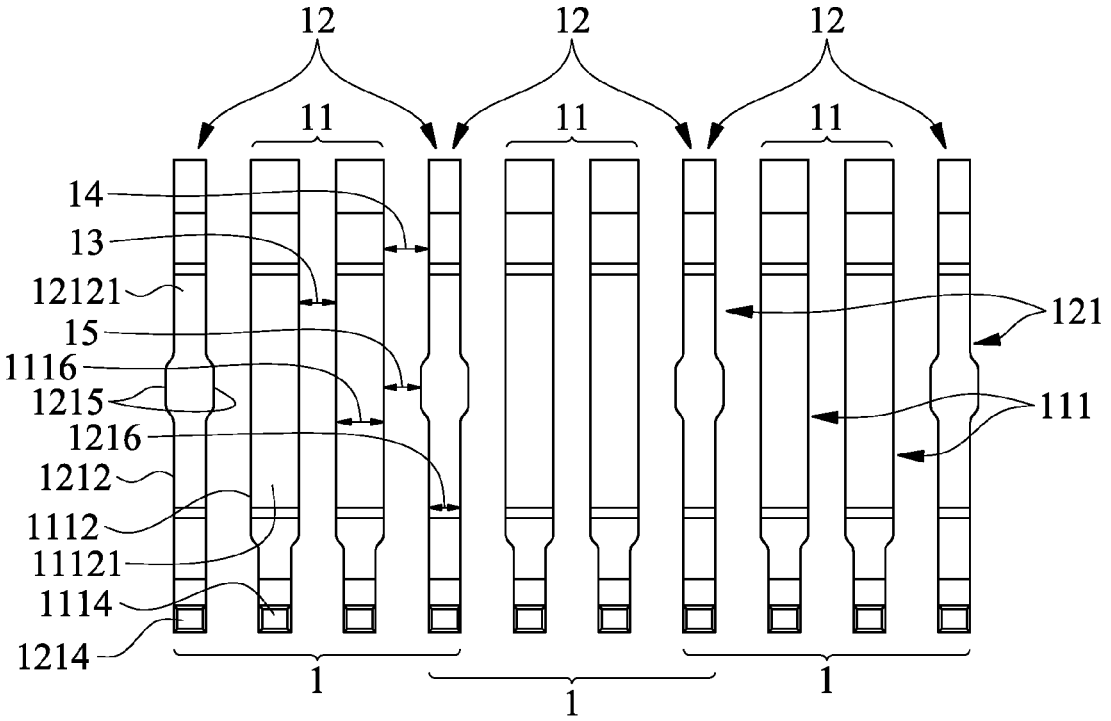
FIG. 3 is a right lateral view of the terminal set of an electrical connector.
Figure 4:
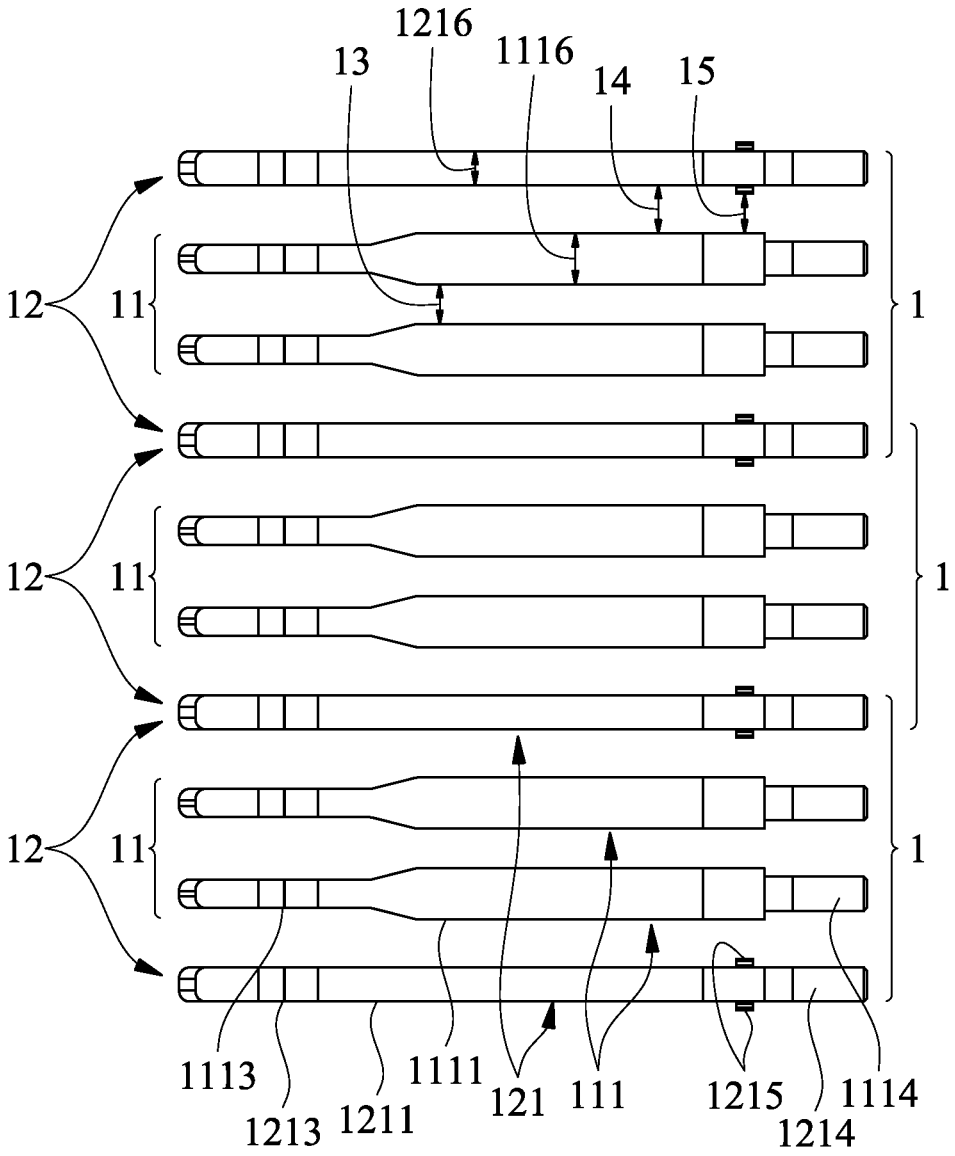
FIG. 4 is a top schematic view of the terminal set of an electrical connector.
Figure 5:
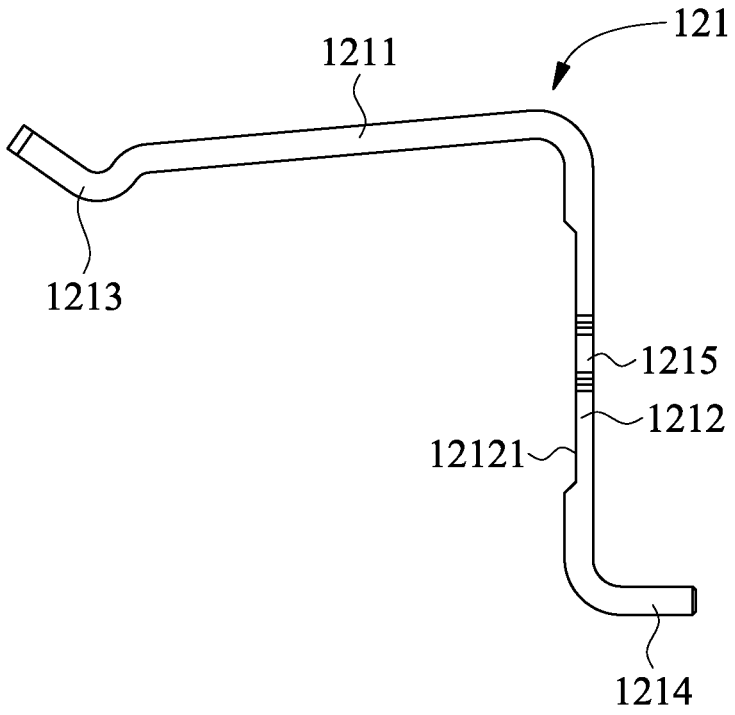
FIG. 5 is a schematic view of a ground terminal with a second recess according to the specific embodiment of the present invention.
Figure 6:
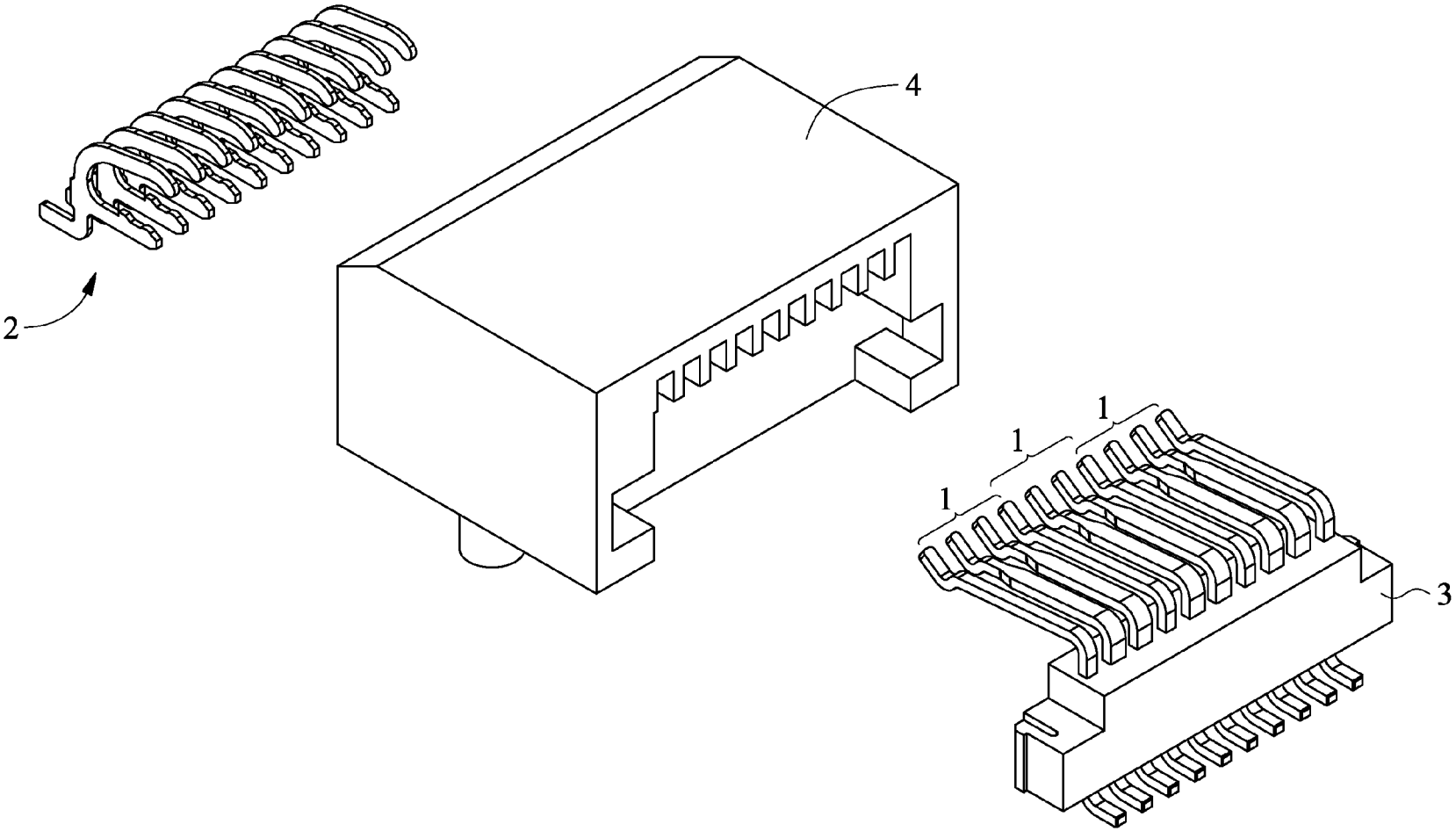
FIG. 6 is an exploded view that shows that the terminal set of an electrical connector is coupled to a stand but separated from a lower terminal set and a casing according to the specific embodiment of the present invention.
Figure 7:
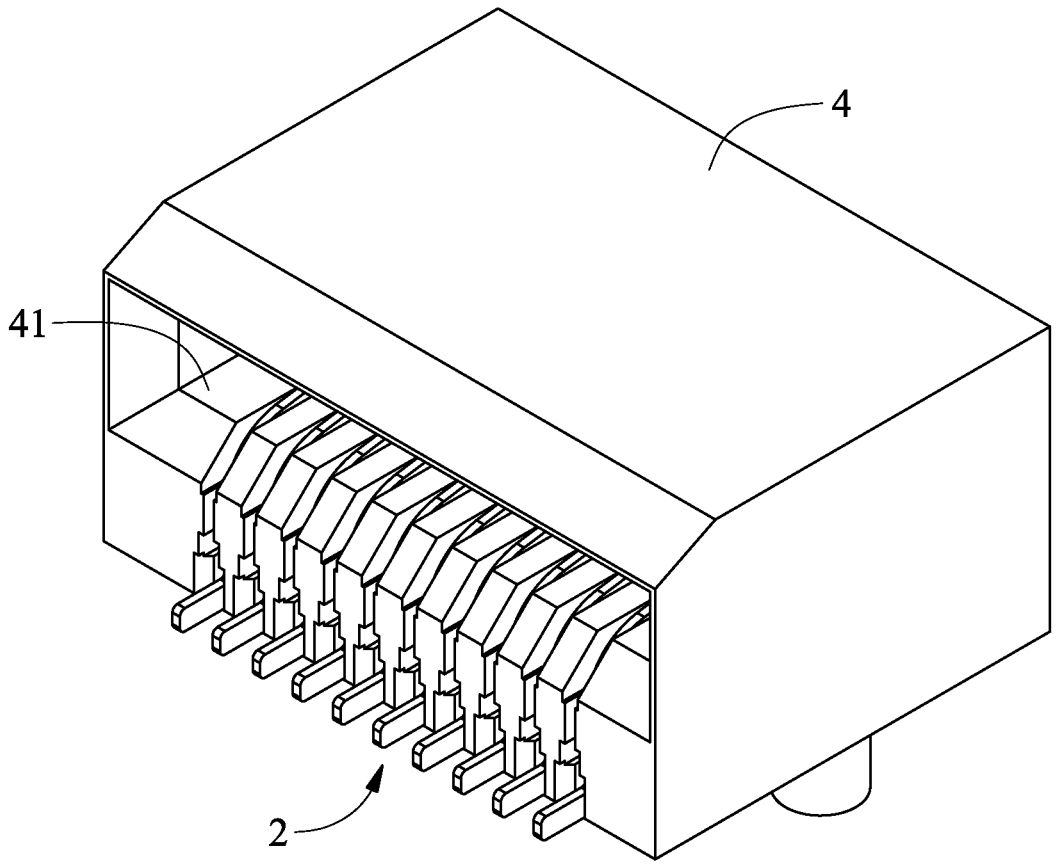
FIG. 7 is a perspective view that shows that the terminal set of an electrical connector, the stand, the lower terminal set, and the casing are put together according to the specific embodiment of the present invention.
Figure 8:
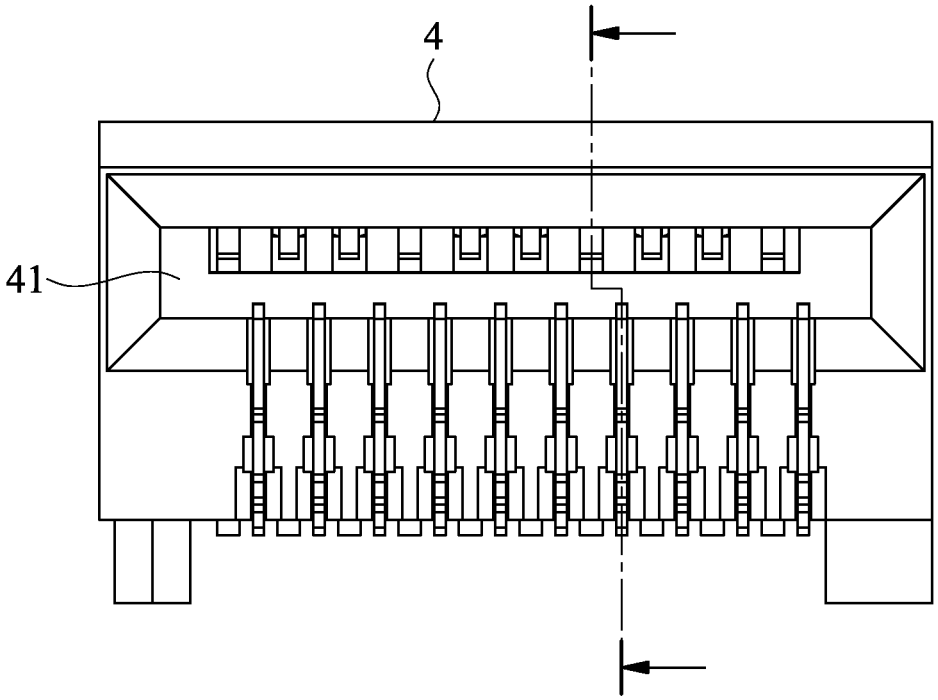
FIG. 8 is a front view of FIG. 7.
Figure 9:
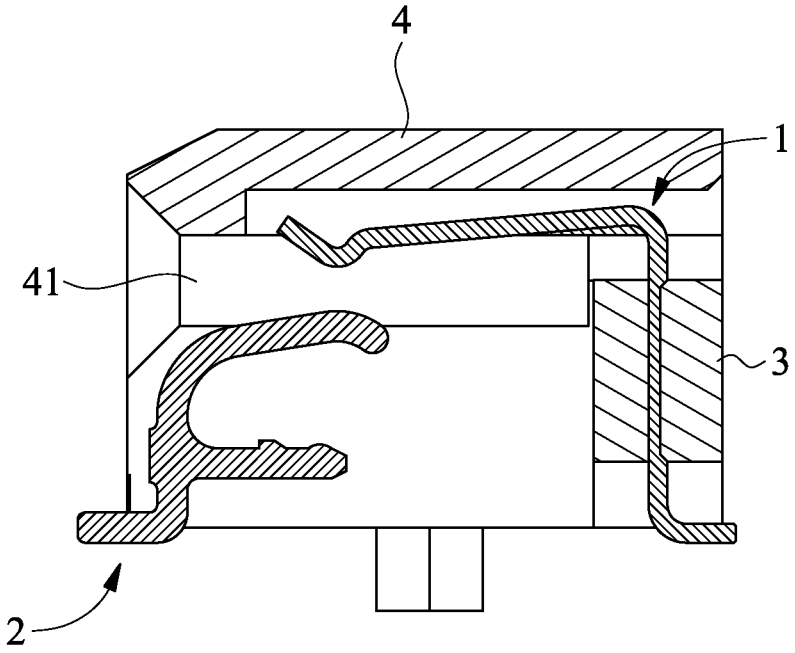
FIG. 9 is a cross-sectional view of FIG. 8 taken along the long and short dashed line thereof.

Referring to FIG. 1 and FIG. 3, the bulging portion 1215 is spaced transversely apart from a corresponding one of the signal terminals 111 by a third distance 15. The first distance 13 is equal to or longer than the third distance 15. For these reasons, the first distance 13 is shorter than the second distance 14 to thereby alleviate inter-terminal resonance.

Referring to FIG. 1 and FIG. 3, the ground terminals 121 has a transverse width 1216 (the transverse width of the bulging portion-free part of the ground terminals 121) which is less than a transverse width 1116 of the signal terminals 111. Due to the transverse width 1216 of the ground terminals 121, the transverse width 1216 of the ground terminals 121 is shorter than the transverse width 1116 of the signal terminals 111, such that the first distance 13 is shorter than the second distance 14 to thereby alleviate inter-terminal resonance.

Referring to FIG. 1 and FIG. 2, the front end of the first electrical connection portion 1111 and the front end of the second electrical connection portion 1211 have their respective curved electrical connection structures 1113, 1213. As soon as a terminal of an inserted component (not shown) moves horizontally toward the first fixing portion 1112 and the second fixing portion 1212 and pushes the front end of the first electrical connection portion 1111 and the front end of the second electrical connection portion 1211 upward, the terminal of the inserted component pushes the front end of the first electrical connection portion 1111 and the front end of the second electrical connection portion 1211 upward smoothly because of the smooth lower edges of the curved electrical connection structures 1113, 1213 in a less laborious manner and in a way conducive to reduction of wear.

Referring to FIG. 1 and FIG. 2, the lower end of the first fixing portion 1112 and the lower end of the second fixing portion 1212 either face away from or face the first electrical connection portion 1111 and the second electrical connection portion 1212 and extend horizontally to form fixing structures 1114, 1214, respectively. Due to the fixing structures 1114, 1214, the lower end of the first fixing portion 1112 and the lower end of the second fixing portion 1212 have a relatively large surface area whereby the lower end of the first fixing portion 1112 and the lower end of the second fixing portion 1212 are either connected and fixed to, or soldered and fixed to, a circuit board or any other electrical structure (not shown) firmly.

Referring to FIG. 6 through FIG. 9, in a variant embodiment of the present invention, the terminal set 1 of an electrical connector is coupled to a stand 3 in an embedded and ejected manner and then coupled to a lower terminal set 2 before being coupled to a casing 4 to form an electrical connector. Afterward, a terminal of an inserted component (not shown) is inserted, through a slot 41 of the casing 4, into the electrical connector so as to be electrically connected to the terminal set 1 and the lower terminal set 2. Furthermore, Referring to FIG. 1 and FIG. 6, as soon as the terminal set 1 of an electrical connector and the stand 3 get coupled together, the first recesses 11121 of the signal terminals 111, the second recesses 12121 of the ground terminals 121, and the bulging portions 1215 together enable the signal terminals 111 and the ground terminals 121 to be snap-engaged with the stand 3.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A terminal set of an electrical connector, comprising:

signal terminal duos having two signal terminals, the signal terminals being spaced apart transversely and each having a first recess, wherein direction of a depth of the first recess equals longitudinal direction of the signal terminals; and ground terminal duos having two ground terminals flanking the signal terminal duos, the ground terminals each having a second recess and being spaced apart transversely from the signal terminals, wherein direction of a depth of the second recess equals longitudinal direction of the ground terminals.

2. The terminal set of an electrical connector according to claim 1, wherein the signal terminals each comprising a first electrical connection portion and a first fixing portion, the first recess being disposed at one of the first fixing portion and the first electrical connection portion, and the ground terminals each comprising a second electrical connection portion and a second fixing portion, the second recess being disposed at one of the second fixing portion and the second electrical connection portion.

3. The terminal set of an electrical connector according to claim 2, wherein the first recess either faces away from or faces the first electrical connection portion when the first recess is disposed at the first fixing portion and either faces away from or faces the first fixing portion when the first recess is disposed at the first electrical connection portion, and the second recess either faces away from or faces the second electrical connection portion when the second recess is disposed at the second fixing portion and either faces away from or faces the second fixing portion when the second recess is disposed at the second electrical connection portion.

4. The terminal set of an electrical connector according to claim 2, wherein an end of the first electrical connection portion and an end of the second electrical connection portion have their respective curved electrical connection structures.

5. The terminal set of an electrical connector according to claim 2, wherein an end of the first fixing portion and an end of the second fixing portion either faces away from or faces the first electrical connection portion and the second electrical connection portion and extend to form fixing structures, respectively.

6. A terminal set of an electrical connector, comprising:

signal terminal duos having two signal terminals, the signal terminals being spaced apart transversely by a first distance and each having a first recess, wherein direction of a depth of the first recess equals longitudinal direction of the signal terminals; and ground terminal duos having two ground terminals flanking the signal terminal duos, the ground terminals each having a second recess, being spaced apart transversely from a corresponding one of the signal terminals by a second distance, and having at least a bulging portion bulging out transversely, wherein direction of a depth of the second recess equals longitudinal direction of the ground terminals, the first distance being shorter than the second distance.

7. The terminal set of an electrical connector according to claim 6, wherein the signal terminals each comprising a first electrical connection portion and a first fixing portion, the first recess being disposed at one of the first fixing portion and the first electrical connection portion, and the ground terminals each comprising a second electrical connection portion and a second fixing portion, the second recess being disposed at one of the second fixing portion and the second electrical connection portion.

8. The terminal set of an electrical connector according to claim 7, wherein the first recess either faces away from or faces the first electrical connection portion when the first recess is disposed at the first fixing portion and either faces away from or faces the first fixing portion when the first recess is disposed at the first electrical connection portion, and the second recess either faces away from or faces the second electrical connection portion when the second recess is disposed at the second fixing portion and either faces away from or faces the second fixing portion when the second recess is disposed at the second electrical connection portion.

9. The terminal set of an electrical connector of claim 7, wherein the bulging portion is disposed at one of the second fixing portion and the second electrical connection portion.

10. The terminal set of an electrical connector according to claim 7, wherein an end of the first electrical connection portion and an end of the second electrical connection portion have their respective curved electrical connection structures.

11. The terminal set of an electrical connector according to claim 7, wherein an end of the first fixing portion and an end of the second fixing portion either face away from or face the first electrical connection portion and the second electrical connection portion and extend to form fixing structures, respectively.

12. The terminal set of an electrical connector according to claim 6, wherein the bulging portion is spaced transversely apart from a corresponding one of the signal terminals by a third distance, and the first distance is not shorter than the third distance.

13. The terminal set of an electrical connector according to claim 6, wherein the ground terminals have a smaller transverse width than the signal terminals.

* * * * *